United States Patent [19]

Leslie

[11] Patent Number: 4,759,077

[45] Date of Patent: Jul. 19, 1988

[54] LARGE CAPACITY COLLAPSIBLE INSULATED CARRIER

[76] Inventor: Peter C. Leslie, 1335 Creek Rd., Chadds Ford, Pa. 19317

[21] Appl. No.: 15,995

[22] Filed: Feb. 18, 1987

[51] Int. Cl.[4] ..... B65D 33/06

[52] U.S. Cl. ..... 383/18; 220/3.1; 224/151

[58] Field of Search ..... 224/151, 148; 220/3.1; 383/7, 20, 18; 62/457, 371

[56] References Cited

U.S. PATENT DOCUMENTS

| | | | |
|---|---|---|---|
| 4,010,784 | 3/1977 | Nattrass et al. | 383/20 |
| 4,362,199 | 12/1982 | Futerman | 383/18 X |
| 4,513,895 | 4/1985 | Leslie | 224/151 |

*Primary Examiner*—Henry J. Recla
*Assistant Examiner*—David Voorhees
*Attorney, Agent, or Firm*—Norman B. Rainer

[57] ABSTRACT

A collapsible insulated carrier device is provided for transporting a single large container of a cold beverage such as a keg of beer. The carrier is a multi-layer construction, having an internally disposed thermally insulative shell fabricated of closed cell resilient polymer, a stress-bearing harness disposed upon the exterior of the shell, and an outer jacket of strong thin fabric that encompasses the shell and harness. Carrying handles are sewn through the jacket and into engagement with the harness. Such manner of association of the handles with the harness prevents tearing stresses from concentrating upon the bottom of the fabric jacket or the sites of handle attachment.

1 Claim, 2 Drawing Sheets

LARGE CAPACITY COLLAPSIBLE INSULATED CARRIER

BACKGROUND OF THE INVENTION

This invention concerns a carrier device, and more particularly relates to a thermally insulated device for transporting a single large container of a cold beverage such as a keg of beer.

Many thermally insulated beverage-carrying devices have earlier been disclosed. Several distinct categories of such devices may be delineated based upon their structural characteristics and intended use. Rigid-walled coolers are most common for general recreational use, such coolers having a single large internal rectangular compartment capable of accommodating a variety of small beverage containers and coolant such as ice. Because of their heavy and cumbersome nature, rigid-walled coolers are not easily lifted into and removed from awkward locations such as the trunk of an automobile.

Industrial insulative carriers have been disclosed for the commercial transportation of containers of uniform size, and are designed to be compatible with mechanized mass-production handling techniques.

Light weight flexible-walled insulative containers are known for versatile outdoor recreational use as by hikers, boaters, campers and hunters. Although well suited for their intended purposes, they cannot be adapted to the very specialized task of hauling a cargo sufficiently heavy to require the effort of two persons.

There is a current popularity in providing kegs of beer at parties and other festive activities. The kegs, generally of a standardized size, are obtained from the brewery filled with cold beer. The filled keg must then be transported to the site of the party and kept cold for the duration of the party while permitting easy dispensation of beer therefrom. Most usually, the filled keg is lifted into the trunk of a car by two persons, transported to the site of use, and then placed in a large tub, drum or barrel containing ice. The tub, the keg, and the ice, usually packaged as cubes in polyethylene bags, generally occupies an amount of space exceeding the capacity of the trunk or other space in most automobiles. The tub or equivalent surrounding structure into which the keg is placed is highly inefficient in cooling the keg because the upper extremities of the keg usually extends beyond the level of ice cubes in the tub. If the tub were chosen so large that the keg would be completely submerged within ice cubes confined by the tub, the size of the tub would be so large as to make it completely unwieldy, and would create difficulties in the removal of the beer from the keg.

It is accordingly an object of the present invention to provide a thermally insulative carrier for a keg of beer.

It is another object of this invention to provide a carrier as in the foregoing object which is of light weight, collapsible construction.

It is a further object of the present invention to provide a carrier of the aforesaid nature which completely envelopes the keg yet permits removal of beer therefrom.

It is still another object of this invention to provide a carrier of the aforesaid nature of rugged, durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a carrier device comprising:

(a) an insulative shell fabricated of closed cell polyethylene foam and comprised of a cylindrical sidewall of uniform thickness and a flat circular bottom which together define an interior cavity having an open top, (b) a water-impervious inner liner of a compliant polymeric film removeably disposed within said cavity in contact with said sidewall and bottom, (c) a stress-bearing harness comprised of webbing that lies flat against the exterior surfaces of the bottom and sidewall of the shell.

(d) an outer jacket comprised of strong thin fabric surrounding said shell and harness in close-fitting contact therewith, (e) carrying handles disposed about the upper extremity of said jacket in diametrically opposed relationship and sewn to said jacket in a manner with penetratively engages the underlying harness, and (f) top closure comprised of a panel of fabric attached to the upper extremity of said jacket and adapted to be drawn radially inward to a centered closure site.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
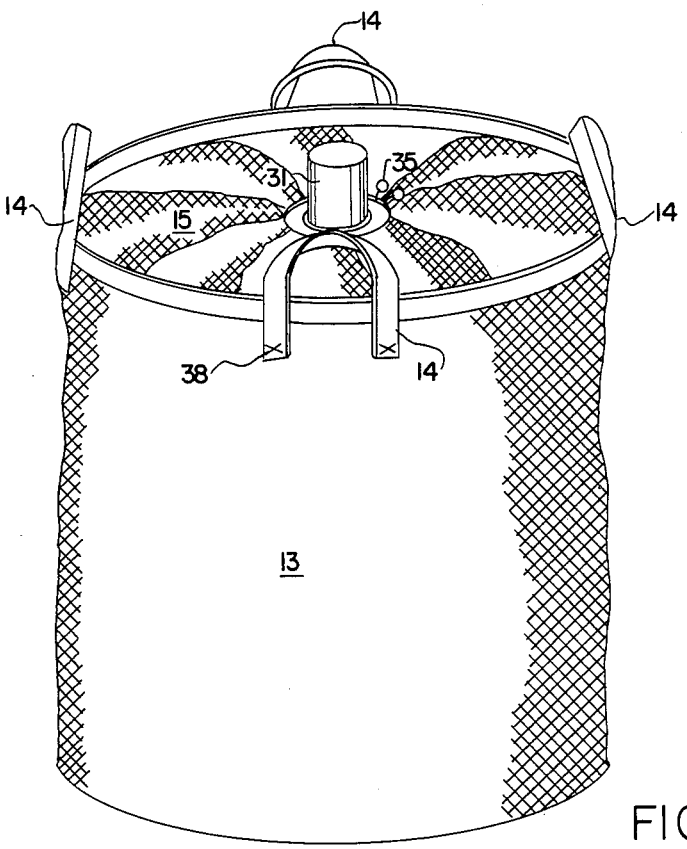
FIG. 1 is a perspective view of an embodiment of the carrier of this invention shown in operative association with a beer keg.
Figure 2:
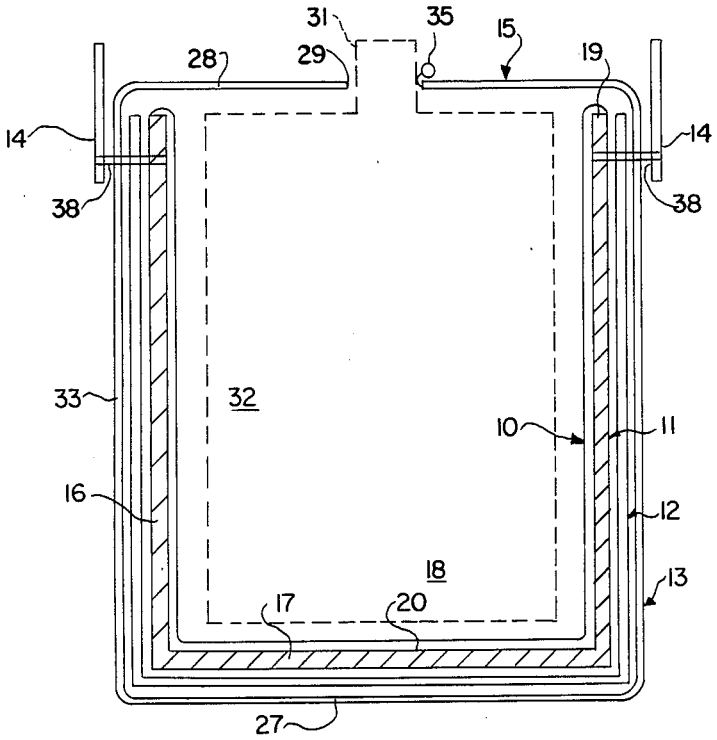
FIG. 2 is a vertical sectional view of the carrier of FIG. 1.
Figure 3:
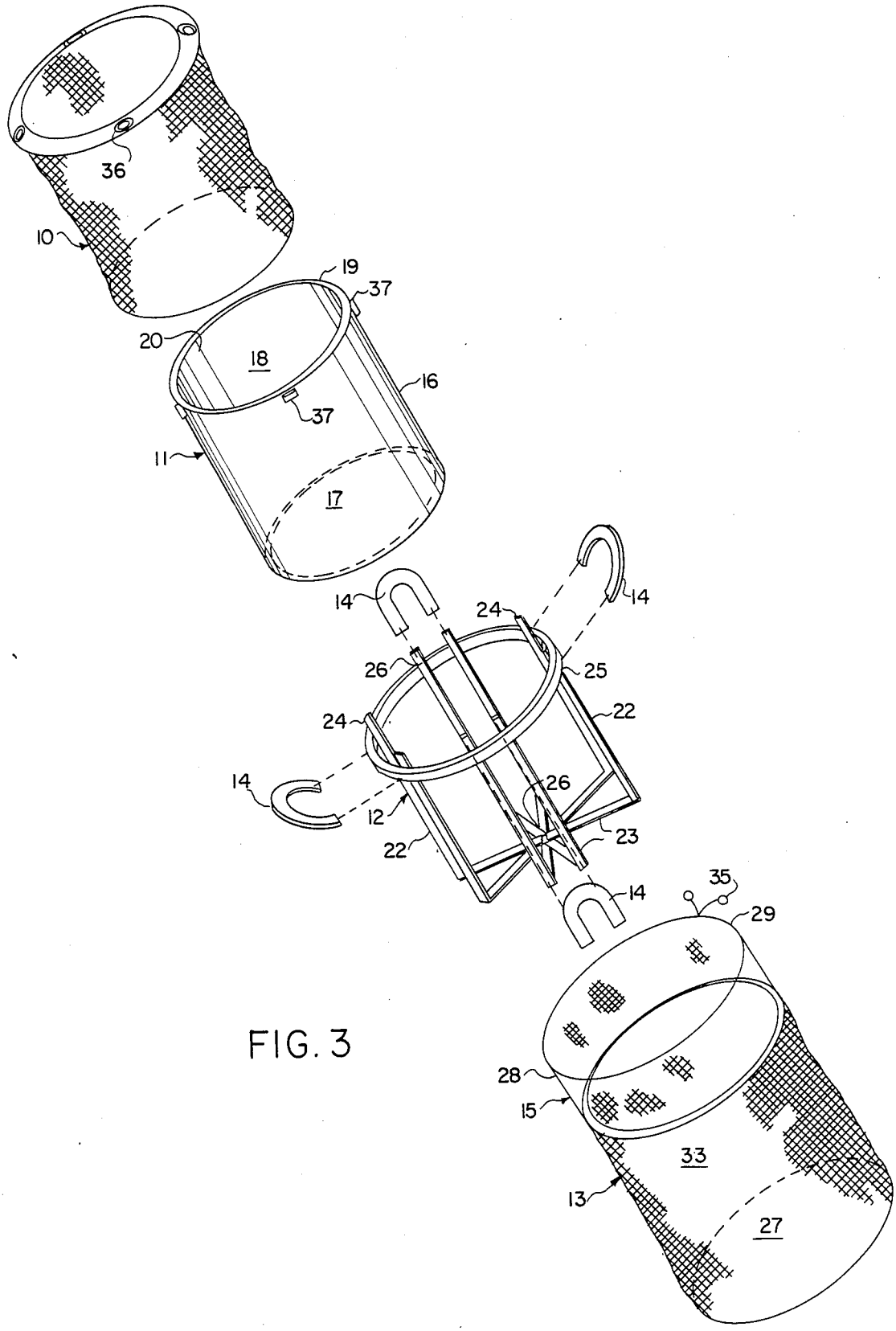
FIG. 3 is an exploded view of the carrier of FIG. 1.

Referring to FIGS. 1–3, an embodiment of the carrier of this invention is shown comprised of inner liner 10 surrounded in turn by insulative shell 11, harness 12 and outer jacket 13 equipped with carrying handles 14 and top closure 15. A beer keg 32 is shown seated within interior cavity 18 of the carrier, and having a pouring spout 31 centered upon the axis of the cavity and protruding above top closure 15.

The insulative shell is fabricated of closed cell polyethylene foam having a bulk density between about 1.8 and 2.5 pounds per cubic foot, and having a thermal conductivity K factor between about 0.1 and 0.4 in the following units: (BTU·in)/(hr·ft$^2$·°F). The shell is comprised of a cylindrical sidewall 16 having a uniform thickness of between ¼ and 1 inch, and a circular bottom panel 17 of comparable thickness. The sidewall will typically have a diameter of about 22 inches and a height between about 15 and 30 inches. The bottom panel and sidewall define an interior cavity 18 having open top 19. By virtue of its foam structure and low density, the shell is flexible, permitting reversible compaction for storage purposes.

Inner liner 10 is comprised of a compliant film such as plasticized polyvinyl chlorine or polyethylene fabricated in the form of a bag adapted to lie in contact with the interiorly-directed surfaces 20 of the shell. The film may have a thickness between about 10 and 20 mils. The upper extremity of liner 10 is provided with apertures 36 adapted to engage buttons 37 on the upper exterior surface of sidewall 16 when the upper extremity of the liner is folded downwardly over the upper extremity of said sidewall. The liner causes cavity 18 to be water-impervious and easily cleanable. Alternative means may, however, by employed to anchor the upper extremity of the inner liner to the insulative shell.

The illustrated embodiment of harness 12 is comprised of four U-shaped straps 21, each having opposed side portions 22 of substantially equal length and a bottom portion 23 extending perpendicularly between said side portions. The U-shaped straps are disposed such that bottom portions 23 cross at their midpoints while side portions 22 are parallel and oriented in the same direction. The upper extremities 24 of side portions 22 are substantially coplanar. A circular strap 25 perpendicularly crosses side portions 22 at sites equally spaced above bottom portions 23.

The straps are preferably fabricated of nylon or polypropylene webbing, tight weave, 2 inches wide. Suitable webbing is of the type generally utilized as seat belt restraint systems in automobiles and aircraft. The aforesaid sites of crossing of the straps of the harness are designed by numeral 26 in FIG. 3. At said sites of crossing, nine in number, the straps are sewn together preferably using strong nylon thread in a double box X pattern. It is to be noted that the site of crossing of bottom portions 23 is disposed on the center axis of shell 11. In other embodiments, fewer or greater numbers of straps may be employed in the harness member.

The interior dimensions of the harness are such as to facilitate snug-fitting accommodation of the insulative shell. The primary purpose of the harness is to uniformly transfer the weight of the contents of cavity 18 to the jacket, and particularly to prevent such weight from being entirely born by the bottom of the jacket. The harness further secures the insulative shell while providing attachment means for the jacket, as will hereinafter be shown.

Jacket 13 is the exterior component of the insulative carrier of this invention. The jacket is preferably made of a strong lightweight fabric comprised of nylon, polyester or other durable synthetic fiber. The fabric is preferably washable, mildew proof, non-absorbent, shrink-resistant and stain-resistant. The jacket may be formed from flat fabric stock by forming a straight seam along the sidewall 33, and a circular seam connecting the bottom of the sidewall to bottom panel 27.

The jacket is contoured in a manner to closely fit around the bottom and sidewall of shell 11. Bottom panel 27 of the jacket, adapted to lie in contact with the bottom panel of the shell, is preferably of double fabric thickness for longer wear.

Top closure 15 is comprised of fabric apron 28, one edge of which is attached to the upper perimeter of the jacket. The parallel distal edge 29 of apron 28 is equipped with drawstring 35 adapted to gather edge 29 about the center axis of interior cavity 18 and into tight contact with pouring spout 31 of keg 32.

Diametrically opposed carrying strap handles 14 are attached to the carrier by sewn engagement 38 with the sidewall of the jacket and with the upper extremities of side portions 22 of the straps of the harness. The handles thereby function as upward extensions of side portions 22 of the harness straps. By virtue of such manner of engagement of the handles, the weight of the carrier and the contents will not bear entirely upon bottom panel 27 of the jacket, nor will stresses be concentrated upon the handles. In the absence of the harness member and its specialized manner of engagement with handles 14, the considerable weight of the carrier and its contents would probably tear the circular seam at the bottom of the fabric jacket.

In use, the beer keg is inserted into the carrier at the retail outlet and carried by two persons to a waiting transportation vehicle. If the combined keg and carrier is too bulky to fit within the vehicle, the carrier may be separated from the keg and collapsed to a more compact storage state. The keg is then carried from the vehicle within the carrier to the site of use, where the beer is insulatively stored within the carrier and dispensed from the pouring spout 31 of the keg in vertical or horizontal disposition. Ice or thermal insulation may be placed atop the closure apron for additional effectiveness in maintaining the beer at low temperature. It is to be further noted, as shown in FIG. 2, that the keg may be smaller than the dimensions of cavity 18, thereby allowing space for ice cubes to surround the keg.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A collapsible carrier device comprising:

(a) a thermally insulative shell fabricated of closed cell polymeric foam and comprised of a cylindrical sidewall of uniform thickness and a flat circular bottom panel which together define an interior cavity having interior and exterior surfaces and an open top, (b) a water-impervious inner liner of a compliant polymeric film removeably disposed within said cavity in contact with the interior surfaces thereof, said liner having an upper extremity provided with apertures and adapted to fold over said top and downwardly to engagement with anchor means on the exterior surface of said sidewall, (c) a stress-bearing harness comprised of:

(1) at least 4 U-shaped straps that lie flat against the exterior surfaces of the bottom panel and sidewall, each strap comprised of opposed side portions of substantially equal length and a bottom portion extending perpendicularly between said side portions, the bottom portions of said straps crossing each other at their midpoints upon the exterior surface of said bottom panel at a site on the center axis of said sidewall, and (2) a circular strap which lies flat against the exterior surface of said sidewall and crosses the side portions of said U-shaped straps, (3) said straps being sewn together at their sites of crossing, (d) an outer jacket comprised of strong thin fabric surrounding said shell and harness in close-fitting contact therewith, (e) carrying handles disposed about the upper extremity of said jacket in diametrically opposed relationship and sewn to said jacket in a manner which penetratively engages the underlying harness at the sites where the circular strap crosses the U-shaped straps, and (f) a top closure comprised of a panel of fabric attached to the upper extremity of said jacket and adapted to be drawn radially inward to a centered closure site.

* * * * *